US007348119B2

(12) United States Patent
Torigoe et al.

(10) Patent No.: US 7,348,119 B2
(45) Date of Patent: Mar. 25, 2008

(54) TONER FOR DEVELOPING ELECTROSTATIC LATENT IMAGE, METHOD FOR MANUFACTURING TONER, AND DEVELOPER FOR DEVELOPING ELECTROSTATIC LATENT IMAGE

(75) Inventors: Tetsu Torigoe, Minamiashigara (JP); Noriyoshi Takahashi, Minamiashigara (JP); Sueko Sakai, deceased, late of Minamiashigara (JP); by Teruo Sakai, legal representative, Minamiashigara (JP); Emi Takahashi, Minamiashigara (JP); Teigen Ri, Chungju (JP)

(73) Assignee: Fuji Xerox Co., Ltd., Tokyo (JP)

( * ) Notice: Subject to any disclaimer, the term of this patent is extended or adjusted under 35 U.S.C. 154(b) by 431 days.

(21) Appl. No.: 11/167,266

(22) Filed: Jun. 28, 2005

(65) Prior Publication Data

US 2006/0210901 A1 Sep. 21, 2006

(30) Foreign Application Priority Data

Mar. 18, 2005 (JP) ..... 2005-080561

(51) Int. Cl.
*G03G 9/00* (2006.01)

(52) U.S. Cl. ..... 430/108.6; 430/108.1; 430/137.14

(58) Field of Classification Search ..... 430/108.6, 430/108.1, 137.14
See application file for complete search history.

(56) References Cited

FOREIGN PATENT DOCUMENTS

| | | |
|---|---|---|
| JP | A 3-174544 | 7/1991 |
| JP | A 5-6021 | 1/1993 |

*Primary Examiner*—Mark A. Chapman
(74) *Attorney, Agent, or Firm*—Oliff & Berridge, PLC

(57) ABSTRACT

The present invention provides a toner for developing an electrostatic latent image including: toner mother particles containing a binder resin and a colorant; and manganese compound particles having a γ-type crystalline structure, the production method thereof, and a developer containing the toner.

15 Claims, No Drawings

TONER FOR DEVELOPING ELECTROSTATIC LATENT IMAGE, METHOD FOR MANUFACTURING TONER, AND DEVELOPER FOR DEVELOPING ELECTROSTATIC LATENT IMAGE

CROSS-REFERENCE TO RELATED APPLICATION

This application claims priority under 35 USC 119 from Japanese Patent Application No. 2005-80561, the disclosure of which is incorporated by reference herein.

BACKGROUND OF THE INVENTION

1. Field of the Invention

The present invention relates to a toner for developing an electrostatic latent image by an electrophotographic method, an electrostatic recording method, and an electrostatic printing method; a method for manufacturing the toner, and a developer for developing an electrostatic latent image.

2. Description of the Related Art

Copiers, printers, facsimiles, and complex machines combining functions of a copier, printer and facsimile, conducting a dry developing method in an electrostatic copying system are used in various fields ranging from office use to personal use. This has led to stronger demand for not only high image quality, but also reduction in size and weight of the device itself, ecological considerations such as resource-saving and recycling capability, and low running cost. To meet such demands, various improvements in image formation methods have been proposed, and research and development on new image formation methods have been considered.

An image formation method currently most widely used is a two-component development method. In this method, only the toner in the developer is consumed, which causes the concentration of the toner in the developer to reduce. Thus, a replenishment toner must be supplied to the developer so that the mixing ratio of the toner and carrier can remain constant. Therefore, the two-component development method has a disadvantage of enlarging the size of the development device.

On the other hand, a one-component development method does not have the above disadvantage, and is advantageous in reducing the size and weight of the device. However, the method has a disadvantage in that developing history easily appears as a development afterimage, rendering it difficult to obtain high image quality.

Generally, in order to reduce the size of a development device, miniaturization of device components is required, and it is particularly important to reduce the diameter and thickness of a photoreceptor and a developer-holding member. However, for example, when the diameter and thickness of the photoreceptor are reduced, the curvature of the photoreceptor becomes large. Thereby, the width of the contacting portion between a cleaning member such as a cleaning blade and the photoreceptor becomes narrow, making cleaning the photoreceptor difficult. When the thickness of the photoreceptor is further reduced, the mechanical strength of the photoreceptor also diminishes. In this case, if the contact pressure of the cleaning member to the photoreceptor is not reduced, the photoreceptor distorts, and uneven pressure occurs. Meanwhile, adhesion of local linear foreign substances and filming on the surface of the photoreceptor occur under a low temperature and low humidity environment. Therefore, when the contact pressure of the cleaning blade to the photoreceptor is reduced, cleaning failure occurs.

On the other hand, as a measure to reduce running costs, less toner consumption by reducing the diameters of the toner particles, and extending the life of the photoreceptor by using a photoreceptor having abrasion resistance have been examined. Various proposals have been suggested for an organic photoreceptor in which an abrasion-resistant layer is disposed as the surface layer and for a photoreceptor mainly made of amorphous silicon to be used as the photoreceptor having abrasion resistance. However, the abrasion resistance of such photoreceptors is extremely good. Therefore, foreign substances, which are removed from the photoreceptor with abrasion of the photoreceptor, undesirably remain on the surface of the photoreceptor. Moreover, when the photoreceptor is used for a long period of time, toner components, products obtained by discharging the photoreceptor, and paper powder adhere to the surface of the photoreceptor, generating black spots, image defects (obscure image and defects similar to those occurring at the time that an image is rubbed) and image voids (missing portions of an image).

Conventionally, it is known that adding abrasive particles to a toner is effective for the problem regarding cleaning (refer to, for example, Japanese Patent Application Laid-Open (JP-A) Nos. 3-174544 and 56021).

However, since these abrasive particles promote abrasion of the photoreceptor surface, the life of the photoreceptor is shortened. When a small-sized thin photoreceptor or a photoreceptor having high abrasion resistance is used, the photoreceptor requires use of a large quantity of abrasive particles or abrasive particles having a large particle diameter and large polishing effect. As a result, not only is the life of the photoreceptor shortened, but other problems also occur, such as image voids, black spots, and linear defects due to surface contamination of the developer-holding member, photoreceptor and intermediate transferring member and scanning of the photoreceptor, reduction of density due to reduction in developer electrostatic charging property, fogging, and in-machine contamination.

Therefore, there is a need for a toner for developing an electrostatic latent image, which toner exhibits a high cleaning property with respect to the photoreceptor under various environments such as low temperature and low humidity, and high temperature and high humidity, and which can maintain high image quality over a long period of time, with no image voids, black spots, linear defects, or density reduction due to reduction in developer electrostatic charging property, fogging, and in-machine contamination; a method for manufacturing the toner, and a developer for developing an electrostatic latent image.

SUMMARY OF THE INVENTION

The invention provides a toner for developing an electrostatic latent image, which includes specific oxidizer particles as abrasive particles to suppress excess abrasion and scarring of the photoreceptor, which does not affect charging property and other characteristics of the developer, and which has an excellent cleaning property with respect to the photoreceptor and a developer for developing an electrostatic latent image.

A first aspect of the invention provides a toner for developing an electrostatic latent image including: toner mother particles containing a binder resin and a colorant, and manganese compound particles having a γ-type crystalline structure.

A second aspect of the invention provides a developer for developing an electrostatic latent image, including the toner.

A third aspect of the invention provides a method for manufacturing a toner for developing an electrostatic latent image, including: mixing a resin particle dispersion liquid in which resin particles having a volume-average particle diameter of 1 μm or less are dispersed, and a coloring agent dispersion liquid in which coloring agent particles are dispersed; and aggregating the resin particles and the coloring agent particles to produce agglomerates; heating and fusing the agglomerates to a temperature higher than the glass transition temperature of the resin particles to produce toner mother particles; and mixing the toner mother particles with manganese compound particles having a γ-type crystalline structure.

The invention exhibits a high cleaning property with respect to the photoreceptor under various environments such as low temperature and low humidity environment, and high temperature and high humidity environment, and can maintain high image quality over a long period of time, with no image voids, black spots, or linear defects, or density reduction, fogging or in-machine contamination due to reduction in developer electrostatic charging property.

DETAILED DESCRIPTION OF THE INVENTION

Hereinafter, a toner for developing an electrostatic latent image of the present invention, a method for manufacturing the toner, and a developer for developing an electrostatic latent image will be explained in detail.

<Toner for Developing Electrostatic Latent Image>

The toner for developing an electrostatic latent image of the invention (hereinafter, simply referred to as "toner") includes toner mother particles containing a binder resin and a colorant, and manganese compound particles having a γ-type crystalline structure.

The abrasive particles contained in a developer are generally harder than the substance of a member to be polished, and a method in which deposits on the surface of a photoreceptor are mechanically scraped together with the surface layer of the photoreceptor has been put in practical use as a method for cleaning the surface of the photoreceptor in conventional electronic photography. However, since this method promotes the abrasion of the surface of the photoreceptor, the life of the photoreceptor is shortened. Moreover, since a small-sized thin photoreceptor or a long-life photoreceptor having good abrasion resistance weakens the effect of the method, such a photoreceptor requires use of a large quantity of abrasive particles, or abrasive particles having a large polishing effect and a large particle diameter. This not only shortens the life of the photoreceptor, but also causes image voids, black spots, and linear defects due to surface contamination of a developer-holding member, photoreceptor and intermediate transferring member and scarring of the photoreceptor, and reduction of density, fogging, and in-machine contamination due to reduction in developer electrostatic charging property.

The invention can solve these problems by enabling chemical polishing different from conventional mechanical polishing.

More specifically, the invention includes manganese compound particles having a type crystalline structure as the abrasive particles contained in a toner or a developer. Although the mechanism of the chemical polishing has not been clarified, it is thought the mechanism is as follows. The manganese compound particles having a γ-type crystalline structure (hereinafter, simply referred to as "γ type") have large force of taking electrons away from other compounds, take electrons away from the surface of a photoreceptor (and/or deposits on the surface of the photoreceptor) in the presence of moisture in air, corrode or decompose the surface to cause the surface to become moderately susceptible to polishing. Thereby, the invention can suppress excess polishing and generation of scarring of the photoreceptor which shorten the life of the photoreceptor, and thereby exhibits a good cleaning property with respect to the photoreceptor.

The type of manganese compound particles having a γ-type crystalline structure used in the invention is not particularly limited, as long as the manganese compound particles have large force of taking away electrons from other compounds. However, the manganese compound particles can be, for example, particles of γ-type manganese oxide, γ-type lithium manganese oxide and/or γ-type nickel manganese oxide obtained by an electrolytic method.

Among these, the material(s) of the manganese compound particles is preferably γ-type manganese dioxide obtained by an electrolytic method, and/or γ-type dimanganese trioxide manganese obtained by heating the γ-type manganese dioxide, since they have excellent oxidation (oxidizing action) and shows a satisfactory cleaning effect. In the invention, particles of one of these compounds can be used alone or those of at least two of them can be used together. The toner of the invention can further include electrically conductive agent particles such as carbon black particles to effectively supply electrons to the manganese compound particles.

Furthermore, the toner of the invention can include not only the manganese compound particles of a γ-type crystalline structure but also those of any other crystalline structure. The manganese compound particles of any other crystalline structure can be prepared by heating the γ-type manganese compound particles to partially change its crystalline structure.

Examples thereof include γ-β type, β type and α-type particles. When the toner of the invention also contains the manganese compound particles of any other crystalline structure, the content of the manganese compound of a γ-type crystalline structure contained in the mixed crystals is preferably about 20 to about 100% by mass, and more preferably about 40 to about 100% by mass.

A method for manufacturing the manganese compound particles of a γ-type crystalline structure is not particularly limited, as long as those of a γ-type crystalline structure are contained in the product by the method. However, as described above, they are preferably produced by an electrolytic method, since the manganese compound particles having a γ-type crystalline structure can be simply obtained by the electrolytic method.

Hereinafter, the method for manufacturing the γ-type manganese dioxide particles in which an electrolytic method is conducted, and that for manufacturing the γ-type dimanganese trioxide particles in which the γ-type manganese dioxide obtained by an electrolytic method is heated will be explained.

In manufacturing the γ-type manganese dioxide particles, first, a manganese salt such as manganese sulfate or manganese carbonate is dissolved in sulfuric acid, and the resultant solution is then electrolyzed at a temperature in the range of about 90 to about 98° C. by using, as a positive electrode, titanium or lead and, as a negative electrode, graphite. Next, the γ-type manganese dioxide particles are obtained by removing a material electrically deposited on the positive electrode therefrom, and coarsely grinding, drying, grinding, washing, neutralizing and drying the material.

Furthermore, the resultant γ-type manganese dioxide particles can be heated at a temperature in the range of about 500 to about 1000° C. for a period of time in the range of about 3 to about 20 minutes in an electric furnace and then ground to obtain the γ-type dimanganese trioxide particles.

Although the manganese dioxide particles obtained by this method are γ-type and the dimanganese trioxide particles are also γ-type, the γ-β-type manganese dioxide particles obtained by heating the γ-type manganese dioxide particles at about 400° C. can also be used in the invention.

The thus-obtained crystal particle diameter of the manganese compound particles used in the invention is preferably within the range of about 20 to about 80 nm, and more preferably in the range of about 30 to about 70 nm. When the crystal particle diameter is less than 20 nm, the crystal is unstable, and may not exhibit a stable electron attractive effect. When the crystal particle diameter exceeds 80 nm, the crystal may not attain an accurate, uniform polishing effect.

The crystalline structure (crystal form) can be easily determined by conducting X-ray diffraction measurement of each manganese compound particle, and analyzing the resultant X-ray diffraction pattern. The crystal particle diameter is measured by inputting the electron microscopic images of the manganese compound particles into an image analyzer (LUZEX III (trade name) manufactured by Nireco Corporation, and analyzing the images of 300 primary particles selected at random.

The volume-average particle diameter of the manganese compound particles used in the invention is preferably within the range of about 0.2 μm to about 2.0 μm, and more preferably within the range of about 0.4 μm to about 1.5 μm, in order to exhibit an excellent cleaning property due to uniform oxidation. When the volume-average particle diameter is less than 0.2 μm, the manganese compound particles may sink in the toner particles, and may not exhibit a cleaning property. When the volume-average particle diameter exceeds 2.0 μm, the particles may scar the surface of the photoreceptor, and may separate from the toner and may cause in-machine contamination.

In order that the manganese compound particles adhere to the toner mother particles described later and efficiently exert polishing action or polish promoting action on the surface of the photoreceptor, the ratio (B/A) of the volume-average particle diameter B of the manganese compound particles to the volume-average particle diameter A of the toner mother particles is preferably within the range of about 0.02 to about 0.2, and more preferably within the range of about 0.04 to about 0.1.

The ratio can be obtained as follows. About ten toner particles are selected at random as samples. For each toner particle, the ratio of the average particle diameter of manganese compound particles to the diameter of the toner mother particle to which the manganese compound particles adhere is measured with a scanning electron microscope (SEM). Thereafter, the measured values are averaged, and the resultant average is used as the ratio described above.

The amount of the manganese compound particles to be added to the toner mother particles is preferably about 0.1 to about 10% by mass, more preferably about 0.2 to about 8% by mass, and still more preferably about 0.5 to about 6% by mass.

Setting the amount to a value in the range of about 0.1 to about 10% by mass not only can maintain the polishing action, but also can prevent the manganese compound particles from causing abrasion of the photoreceptor, surface contamination of a developer-holding member, photoreceptor and intermediate transferring member, and scarring of the photoreceptor, and influencing developer electrical charging property.

When the manganese compound particles and other abrasive particles are used together, the polishing effect can be further enhanced. Although known abrasive particles can be used as other abrasive particles, inorganic particles having a particularly excellent polishing property can be preferably used. Examples of the inorganic particles include particles of inorganic oxides, nitrides and borides such as cerium oxide, alumina, silica, titania, zirconia, barium titanate, germanium oxide, aluminium titanate, strontium titanate, magnesium titanate, zinc oxide, chromium oxide, antimony oxide, tungsten oxide, tin oxide, tellurium oxide, boron oxide, silicon carbide, boron carbide, titanium carbide, silicon nitride, titanium nitride and boron nitride.

Among these abrasive particles, cerium oxide, titania and/or strontium titanate are particularly preferably used. The volume-average particle diameter of these abrasive particles is preferably about 0.2 to about 2 μm.

The mass ratio (C/D) of the amount (C) of other abrasive particles added and the amount (D) of the manganese compound particles added in the invention is preferably within the range of 0 to about 1.5, and more preferably within the range of 0 to about 1.0.

Inorganic particles having a diameter smaller than that of the manganese compound particle can also be used to improve fluidity and electrical charging property of the toner.

As for the inorganic particles having a diameter smaller than that of the manganese compound particle, the difference between the volume-average particle diameter of the manganese compound particles and that of such inorganic particles is preferably 100 nm or more, and more preferably about 100 to about 800 nm. When the difference is 100 nm or more, the inorganic particles do not hinder contact between the manganese compound particles and the photoreceptor, and the manganese compound particles efficiently come into contact with the photoreceptor, and the inorganic particles do not scar and do not wear away the photoreceptor.

At least one kind of metal oxide is preferably contained as the inorganic particles. The metal oxide can enhance fluidity of the toner, and electrical charging property between the toner particles, whereby quality of image at the time of developing can be enhanced.

Specific examples of the metal oxide include silica, titania, zinc oxide, strontium oxide, aluminum oxide, calcium oxide, and magnesium oxide, and composite oxides thereof. One of the metal oxides may be used alone or at least two of them can be used together. Silica and/or titania are preferably used from the viewpoints of particle diameter, particle size distribution and manufacturing property.

The amount of the inorganic particles added to the toner mother particles is preferably within the range of about 0.1 to about 10% by mass, more preferably within the range of about 0.2 to about 8% by mass, and still more preferably in the range of about 0.5 to about 6% by mass.

The effect of the metal oxide can be easily exhibited and powder fluidity of the toner can be improved by setting the amount to a value in the range of about 0.1 to about 10% by mass. For example, problems such as blocking or the like can be prevented from occurring in a developing unit. Moreover, increase in the amount office external additive particles can be suppressed, and abrasion and scanning of the intermediate transferring member can be thereby suppressed.

The inorganic particles may be subjected to surface modification such as hydrophilic or hydrophobic treatment, if needed. A conventionally known method can be conducted for the surface modification. Specifically, coupling treatment of silane, titanate, aluminate or the like can be conducted.

The coupling agent used in the coupling treatment is not particularly limited, but is preferably a silane coupling agent such as methyltrimethoxysilane, phenyltrimethoxysilane, methylphenyldimethoxysilane, diphenyldimethoxysilane, vinyltrimethoxysilane, γ-aminopropyltrimethoxylsilane, γ-chloropropyltrimethoxysilane, γ-bromopropyltrimethoxysilane, γ-glycidoxypropyltrimethoxysilane, γ-mercaptopropyltrimethoxysilane, γ-ureidopropyltrimethoxysilane, fluoroalkyltrimethoxysilane, or hexamethyldisiloxane; a titanate coupling agent; and/or an aluminate coupling agent.

The volume-average particle diameter of the toner mother particles used in the invention is preferably within the range of about 2 to about 12 μm, and more preferably within the range of about 3 to about 9 μm. When the volume-average particle diameter of the toner mother particles exceeds 12 μm, the proportion of coarse particles becomes high, deteriorating reproducibility of thin lines, minute dots and gradation property of an image obtained through a fixation step. On the other hand, when the volume-average diameter of the toner mother particles is less than 2 μm, powder fluidity, developing property, transferring property and/or cleaning property of the toner (property by which the residual toner can be removed from the photoreceptor to clean the photoreceptor) deteriorate. As described above, deterioration of powder characteristics cause various problems in various steps.

As for the diameter distribution index of the toner mother particles used in the invention, the volume average particle size distribution index GSDv is preferably within the range of about 1.00 to about 1.30, and more preferably within the rang of about 1.10 to about 1.25. The volume average particle size distribution index GSDv of 1.30 or less results in that both fine and coarse powders are few, and the developing, transferring and cleaning properties of the toner can be well maintained.

The volume-average diameter and the volume average particle size distribution index GSDv are obtained as follows. First, a cumulative distribution showing the relation between a divided particle size range (channel) and the ratio (accumulation rate) of the cumulative volume of toner mother particles to the total volume of all the toner mother particles is drawn on the basis of a toner mother particle size distribution measured with a coulter counter TA II (trade name) manufactured by Beckman Coulter., Inc. The accumulation starts at the smallest diameter of the divided particle size range. The particle diameter corresponding to an accumulation rate of 16% is defined as a volume-average particle diameter D16v, and the particle diameter corresponding to an accumulation rate of 50% is defined as a volume-average particle diameter D50v, which is defined as the volume-average particle diameter. Similarly, the particle diameter corresponding to an accumulation rate of 84% is defined as a volume-average particle diameter D84v. The volume average particle size distribution index (GSDv) is defined as $(D84v/D16v)^{1/2}$, and the volume average particle size distribution index (GSDv) can be calculated from this relational expression.

The shape factor SF1 of the toner mother particles used in the invention is preferably within the range of about 110 to about 140, and more preferably within the range of about 120 to about 135.

The balance between cleaning property of the toner and a state in which the manganese compound particles are dispersed on the surfaces of the toner mother particles can be well controlled by setting the shape factor SF1 to a value in the range of about 110 to about 140.

Herein, the shape factor SF1 is calculated from the following formula (1).

$$SF1=(ML^2/A)\times(\pi/4)\times 100 \qquad \text{Formula (1)}$$

In formula (1), ML and A represent the absolute maximum length of a toner mother particle and the projected area of the toner mother particle, respectively.

The shape factor SF1 is generally obtained by analyzing the microscopic images or scanning electron microscopic (SEM) images of toner mother particles with an image analyzer, and for example, can be calculated as follows. That is, the toner shape factor SF1 can be obtained by inputting the optical microscope images of toner mother particles scattered on a slide glass into a Luzex image analyzer through a video camera, calculating the maximum length and projected area of each of hundred toner mother particles selected at random, calculating the shape factors of these toner mother particles from formula (1), and averaging the calculated shape factors.

The toner for developing electrostatic latent image of the invention can be manufactured by producing the toner mother particles described above, adding the abrasive particles such as the manganese compound particles, and optionally other abrasive particles and optionally the inorganic particles to the toner mother particles, and mixing these components with a mixer such as a Henschel mixer.

The manganese compound particles, and optionally the inorganic particles can be added to the surfaces of the toner mother particles in a wet process.

Although the toner mother particles used in the invention can be produced by any method such as a kneading grinding method, a suspension polymerization method, a dissolution suspension method or an emulsion polymerization aggregation method, an emulsion polymerization aggregation method is preferably conducted. This is because the method can provide toner mother particles having a particularly sharp particle size distribution, controlled shapes and controlled surface properties.

A method for producing the toner mother particles used in the invention in accordance with an emulsion polymerization aggregation method will be described later.

On the other hand, when the toner mother particles used in the invention are produced by a kneading grinding method, first, a resin (binder resin), a coloring agent and a releasing agent which will be described in descriptions for an emulsion polymerization aggregation method described later are mixed with a mixer such as a NAUTA MIXER (R), a Henschel mixer, or any other mixer. The resultant mixture is kneaded by a uniaxial or biaxial extruder. After the mixture kneaded is rolled and cooled, the mixture is finely ground by a mechanical or air current grinder such as I-type mill, KTM or a jet mill, and the resultant particles are classified by a classifier using Coanda effect, such as an elbow jet, or by an air classifier such as turbo crash fire and accu cut.

<Method for Manufacturing Toner for Developing Electrostatic Latent Image>

A method for manufacturing the toner of the invention includes: mixing a resin particle dispersion liquid in which resin particles having a volume-average particle diameter of 1 μm or less are dispersed, and a coloring agent dispersion liquid in which coloring agent particles are dispersed, and aggregating the resin particles and the coloring agent particles to produce agglomerates; heating and fusing the agglomerates to a temperature higher than the glass transition temperature of the resin particles to produce toner mother particles; and mixing the toner mother particles with manganese compound particles having a γ-type crystalline structure.

Since the oxidation of the manganese compound particles used in the invention with respect to the surface of a photoreceptor is promoted by moisture in air, it is preferable that a compound containing a hydrophilic group such as a sulfonyl group or a carboxyl group exists on the surfaces of the toner particles.

The toner (mother) particles used in the invention preferably have a specific shape so as to keep well balance between the cleaning property and dispersing state of the manganese compound particles on the surfaces of the toner particles.

Therefore, as described later, manufacture of the toner mother particles by an emulsion polymerization aggregation method can provide toner mother particles on the surfaces of which hydrophilic groups uniformly, efficiently exist, and can enable easy control of the shapes of the toner mother particles, such as obtaining spherical shape.

The emulsion polymerization aggregation method includes: mixing a resin particle dispersion liquid in which resin particles having a volume-average particle diameter of 1 μm or less are dispersed, and a coloring agent dispersion liquid in which coloring agent particles are dispersed, and optionally a releasing agent dispersion liquid in which releasing agent particles are dispersed, and aggregating the resin particles and the coloring agent particles and so on to form agglomerates each having a diameter equal or almost equal to the diameter of a toner mother particle (aggregating step), heating the agglomerates to a temperature higher than the glass transition temperature of the resin particles, and fusing the agglomerates to form toner mother particles (fusing step).

When the resin particles used in the aggregating step are those obtained by using persulfate as a polymerization initiator, the sulfonyl group derived from the polymerization initiator can exist on the surfaces of the toner mother particles as a remaining group. Moreover, when a copolymerizable component having a carboxyl group such as acrylic acid is used in preparation of the resin particles so as to maintain stability of the resin particles at the time of emulsification, the carboxyl group can exist on the surfaces of the toner mother particles.

The resin (binder resin) used in the resin particles is not particularly limited, and can be, for example, a thermoplastic resin. Specifically, polymers of the following monomers can be used: styrenes such as styrene, p-chlorostyrene and α-methylstyrene; esters having a vinyl group such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate; vinyl nitrites such as acrylonitrile and methacrylonitrile; vinyl ethers such as vinyl methyl ether and vinyl isobutyl ether, vinyl ketones such as vinyl methyl ketone, vinyl ethyl ketone and vinyl isopropenyl keton; olefins such as ethylene, propylene and butadiene. Moreover, a cross-linking component, for example, acrylic ester such as pentanediol diacrylate, hexanediol diacrylate, decanediol diacrylate and/or nonanediol diacrylate can be used.

In addition to homopolymers of these monomers, at least one of copolymers obtained by copolymerizing two or more kinds of the monomers, and mixtures including two or more of the homopolymers and the copolymers, non-vinyl condensation resins such as an epoxy resin, a polyester resin, a polyurethane resin, a polyamide resin, a cellulose resin and a polyether resin, and mixtures including two or more of the non-vinyl condensation resins and the vinyl resins, and graft polymers obtained by polymerizing the vinyl monomer in the presence of the non-vinyl resin can be used as the material of the resin particles.

An inorganic peracid salt is suitably used as the polymerization initiator. More specifically, persulfate such as ammonium persulfate, sodium persulfate or potassium persulfate is preferably used to make a sulfonyl group exist on the surfaces of the toner mother particles. Alternatively, peroxide such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethybenzoyl peroxide, lauroyl peroxide, tert-butyl performate, tert-butyl peracetate, tert-butyl perbenzoate, tert-butyl perphenylacetate, tert-butyl permethoxyacetate, and/or tert-butyl N-(3-toluyl) perrarbamate may be used.

Fatty ester having an alkyl group with 4 or more carbon atoms is preferably used as the cross-linking agent. Specific examples thereof include esters of linear polyhydric alcohol and (meth)acrylic acid such as butandiol methacrylate, hexandiol acrylate, octandiol methacrylate, decandiol acrylate and dodecandiol methacrylate, and polyvinyl esters of a polybasic carboxylic acid, such as divinyl adipate, divinyl pimelate, divinyl suberate, divinyl azelate, divinyl sebacate, divinyl dodecandioic acid and divinyl brassylate.

The resin particle dispersion liquid used in the invention can be easily obtained by an emulsion polymerization method or a similar polymerization method of an inhomogeneous dispersion system. Alternatively, the resin particle dispersion liquid can be obtained by any other method, such as a method for adding a polymer obtained by uniformly polymerizing at least one monomer in accordance with a solution polymerization method or a mass polymerization method, and a stabilizer to a solvent in which the polymer is not dissolved, and mechanically mixing the resultant mixture.

As for the diameters of the resin particles contained in the resin particle dispersion liquid of the invention, the volume-average particle diameter of the resin particles is 1 μm or less, and preferably about 100 to about 800 nm. When the volume-average particle diameter exceeds 1 μm, the particle size distribution of toner particles obtained by aggregating and fusing the resin particles and the coloring agent particles broadens, or free particles occur and deteriorate the performance and reliability of the toner. When the volume-average particle diameter is less than 100 nm, aggregating growth of the resin particles and the coloring agent particles may require much time, and may not be industrially suitable. When the volume-average particle diameter is not more than 800 nm, the releasing agent and the coloring agent can be uniformly dispersed, and the surface properties of the toner can be well controlled.

The glass transition temperature of the resin particles used in the invention is preferably within the range of about 45°

C. to about 60° C., more preferably within the range of about 50 to about 60° C., and still more preferably within the range of about 53 to about 60° C. When the glass transition temperature is lower than 45° C., the toner particles are easily blocked by heat. Meanwhile, when the glass transition temperature is more than 60° C., the resultant toner may require an extremely high fixing temperature.

The weight-average molecular weight Mw of the resin particles used in the invention is preferably within the range of about 15,000 to about 60,000, more preferably within the range of about 20,000 to about 50,000, and still more preferably within the range of about 25,000 to about 40000.

Examples of the coloring agent of the toner include magnetic powder such as magnetite and ferrite, carbon black, aniline blue, chalcoyl blue, chrome yellow, ultra marine blue, DuPont oil red, quinoline yellow, methylene blue chloride, phthalocyanine blue pigment, malachite green oxalate, lamp black, rose bengal, C. I. pigment red 48:1, C.I. pigment red 122, C.I. pigment red 57:1, C.I. pigment yellow 97, C.I. pigment yellow 17, C.I. pigment blue 15:1, and C.I. pigment blue 15:3.

Any method, for example, a method using a general dispersing unit such as a rotating shear-type homogenizer, or a ball mill, a sand mill, a dyno mill, or an altimyser, which includes media, can be used as a method of dispersing the coloring agent in a solvent.

Examples of the releasing agent include low-molecule polyethylene, low-molecular polypropylen, Fischer-Tropsch wax, montan wax, carnauba wax, rice wax and candelilla wax.

The releasing agent, an ionic surfactant, and a polymer electrolyte such as polymeric acid or polymeric base are dispersed in water, and the resultant dispersion liquid is heated to a temperature higher than the melting point of the releasing agent and stirred with a homogenizer or a pressure-discharging distributor capable of applying strong shearing force to the content so as to produce a releasing agent dispersion liquid in which releasing agent particles having a volume-average particle diameter of 1 μm or less are dispersed.

The toner particles may contain a charge control agent, if needed The charge control agent can be a well known one, and more specifically, can be an azo metal complex compound, a metal complex compound of salicylic acid or a resinous charge control agent containing a polar group. When the toner mother particles are produced by a wet process, a material hardly dissolved in water can be preferably used as the charge control agent from the viewpoints of easy control of ionic strength and reduction of waste water contamination.

In the aggregating step, particles contained in the resin particle dispersion liquid, and the coloring agent dispersion liquid, and optionally the releasing agent dispersion liquid which are mixed with each other aggregate into agglomerates. The agglomerates are formed by hetero aggregation. An ionic surfactant having polarity different from that of the agglomerates, or an inorganic metal salt having a valence of 2 or higher can be suitably used as a coagulant so as to stabilize the agglomerates and/or to control the particle sizes and/or the particle size distribution of the agglomerates. In particular, when the inorganic metal salt is used, the amount of the surfactant used can be reduced and the electrical charging characteristics can be enhanced.

In the fusing step, the resin particles in the agglomerates are fused at a temperature higher than the glass transition temperature thereof, and the agglomerates, which have an infinite form, are changed into fused particles (toner mother particles) having a spherical shape. Here, the shape factor SF 1 of the agglomerates is 150 or more. The shape factor SF 1 becomes small, as the particles become spherical. Therefore, the shape factor SF1 can be controlled by stopping heating of the fused particles when the shape factor SF 1 of the fused particles has become a desired value. Thereafter, the fused particles are separated from the aqueous medium and, if necessary, washed and dried. Thus, toner mother particles are obtained.

As described above, the fused particles are subjected to a solid-liquid separation step such as filtration, and optionally a washing step and a drying step to produce toner mother particles. In order to secure electrical charging characteristics and reliability which the toner is required to have, it is preferable to fully wash the fused particles.

For example, when the particles are treated by an acid such as nitric acid, sulfuric acid and/or hydrochloric acid, and/or an alkaline solution such as sodium hydroxide and washed with deionized water in the washing step, large washing effect can be obtained. In the drying step, any method such as an ordinary vibration-type flow drying method, a spray drying method, a freezeing method or a flash jet method can be conducted. The moisture content of the toner mother particles dried is preferably 2% by mass or less, and more preferably 1% by mass or less.

The toner for developing electrostatic latent image of the invention can be manufactured by producing the toner mother particles in the above-described manner, adding the manganese compound particles serving as abrasive particles, and optionally other abrasive particles and optionally inorganic particles to the toner mother particles, and mixing these components with a Henschel mixer or any other mixer.

The manganese compound particles, and optionally the inorganic particles can be added to the surfaces of the toner mother particles in a wet process.

<Developer for Developing Electrostatic Latent Image>

The developer for developing an electrostatic latent image (hereinafter, referred to as a developer in some cases) of the invention contains the above-described toner for developing an electrostatic latent image of the invention, and otherwise the developer is not particularly limited, and may contain other components according to its purpose. When the developer contains only the toner of the invention, the developer is a one-component developer. When the developer contains a carrier as well as the toner of the invention, the developer is a two-component developer.

For example, when the developer contains a carrier, the carrier is not particularly limited and can be known carriers. Specific examples thereof include those coated with a resin (resin-coated carriers) described in JP-A Nos. 62-39879, and 56-11461.

As for the resin-coated carriers, examples of the material of the cores thereof include iron powder, and ferrite and magnetite particles. The volume-average particle diameter thereof is within the range of about 30 to about 200 μm. The volume-average particle diameter can be calculated by measuring the diameters thereof by a device which can measure diameters in the range of about 1 μm to about 1000 μm, for example, INSITEC B (trade name) manufactured by Seishin Enterprise Co., Ltd.

Examples of the resin coating of the resin-coated carrier include: homopolymers and copolymers of at least one of styrenes such as styrene, p-chlorostyrene and α-methylstyrene, α-methylene aliphatic monocarboxylic acids such as methyl acrylate, ethyl acrylate, n-propyl acrylate, lauryl acrylate, 2-ethylhexyl acrylate, methyl methacrylate, n-propyl methacrylate, lauryl methacrylate and 2-ethylhexyl methacrylate, nitrogen-containing acrylates such as dimethylaminoethyl methacrylate, vinyl nitrites such as acrylonitrile and methacrylonitrile, vinylpyridines such as 2-vinylpyridine and 4-vinylpyridine, vinyl ethers such as vinyl methyl ether and vinyl isobutyl ether, vinyl ketones such as vinyl methyl ketone, vinyl ethyl ketone and vinyl isopropenyl ketone, olefins such as ethylene and propylene, and fluorinated vinyl monomers such as vinylidene fluoride, tetrafluoroethylene and hexafluoroethylene; silicone resins of methylsilicone and methylphenylsilicone; polyesters containing bisphenol and/or glycol; epoxy resins; polyurethane resins; polyamide resins; cellulose resins; polyether resins; and polycarbonate resins.

One of these resins may be used alone or two or more of them can be used together. The amount of the resin coating is preferably about 0.1 to about 10 parts by mass based on 100 parts by mass of the core particles, and more preferably about 0.5 to about 3.0 parts by mass.

A heating type kneeder, a heating type Henschel mixer and/or a UM mixer can be used to manufacture the carrier. Alternatively, a heating type flow rolling floor and/or a heating type kiln can be used depending on the amount of the resin coating.

The mixing ratio of the toner of the invention and the carrier in the developer of the invention is not particularly limited, and can be suitably selected according to purpose.

Since the developer of the invention contains the toner of the invention, the developer exhibits a high cleaning property under various environments such as low temperature and low humidity environment, and high temperature and high humidity environment, and can maintain high image quality without image voids, black spots, linear defects, reduced density and fogging, over a long period of time.

EXAMPLES

Hereinafter, the invention will be explained in more detail by way of examples. However, the invention is not limited to these examples. In the following explanations, "part" and "%" respectively mean "part by mass" and "% by mass" unless otherwise noted.

<Measurement of Physical Properties>

The following physical properties are measured as follows.

Crystalline Structure of Manganese Compound Particle

X-ray diffraction measurement of manganese compound particles is performed with an X-ray diffraction device RINT 2000 (trade name) manufactured by Rigaku Corporation, and the crystalline structures of the manganese compound particles are analyzed from the X-ray diffraction pattern.

Mean Crystal Particle Diameter of Manganese Compound Particles

The electron microscopic images of the manganese compound particles are inputted into an image analyzer LUZEX Im (trade name) manufactured by Nireco Corporation, the images of 300 primary particles selected at random are analyzed, and the mean crystal particle diameter of the manganese compound particles is calculated from the resultant data.

Volume-Average Particle Diameter of Manganese Compound Particles

The volume-average particle diameter of the manganese compound particles is measured with MICROTRACK UPA150 (trade name) manufactured by Nikkiso Co., Ltd.

Volume-Average Particle Diameters of Resin Particles, Coloring Agent Particles, and Releasing Agent Particles The volume-average particle diameter of resin particles, that of coloring agent particles, and that of releasing agent particles are measured with a laser diffraction type particle size distribution measurement instrument LA-700 (trade name) manufactured by Horiba, Ltd.

Volume-Average Particle Diameter of Toner Mother Particles, and Particle Size Distribution Measuring Method The volume-average particle diameter and particle size distribution index of toner mother particles are measured by using Coulter counter TAII (manufactured by Beckman Coulter., Inc.), and using, as an electrolytic solution, ISOTON-II (manufactured by Beckman Coulter., Inc.).

The measuring method is as follows. 0.5 to 50 mg of a measurement sample (toner mother particles) is added to 2 ml of a 5% solution of sodium alkylbenzenesulfonate serving as a dispersing agent or a surfactant, and the resultant solution is added to 100 to 150 ml of the electrolytic solution. The resultant suspension liquid in which the measurement sample is suspended in the electrolytic solution is stirred with an ultrasonic disperser for about one minute. Thereafter, the particle size distribution of toner mother particles whose diameters are in the range of 2.0 to 60 μm is measured with Coulter counter TA II having an aperture whose diameter is 100 μm.

A cumulative distribution showing the relation between a divided particle size range (channel) and the ratio (accumulation rate) of the cumulative volume of toner mother particles to the total volume of all the toner mother particles is drawn on the basis of the toner mother particle size distribution measured with the Coulter counter TA II. The accumulation starts at the smallest diameter of the divided particle size range. The particle diameter corresponding to an accumulation rate of 16% is defined as a volume-average particle diameter D16v, and the particle diameter corresponding to an accumulation rate of 50% is defined as a volume-average particle diameter D50v, which is the volume-average particle diameter. Similarly, the particle diameter corresponding to an accumulation rate of 84% is defined as a volume-average particle diameter D84v. The volume average particle size distribution index (GSDv) is defined as $(D84v/D16v)^{1/2}$.

Shape Factor Measuring Method of Toner Mother Particles or Toner

The shape factor SF1 of the toner mother particles or toner is obtained by inputting the optical microscopic images of the toner mother particles or the toner scattered on a slide glass into a LUZEX image analyzer through a video camera, obtaining the maximum length and the projected area of each of 50 toner (mother) particles selected at random, calculating the shape factor of each particle from the following formula (1), and averaging the calculated values.

$$SF1=(ML^2/A)\times(\pi/4)\times 100 \quad \text{Formula (1)}$$

In formula (1), ML and A represent the absolute maximum length and the projected area of each toner (mother) particle, respectively.

Molecular Weight Measuring Method of Resin Particles

The molecular weight of the resin particles is measured with gel permeation chromatography (GPC). HLC-8120GPC and SC-8020 (trade names) manufactured by Tosoh Corporation are used as GPC devices. Two TSK gel Super HM-Hs (trade name) manufactured by Tosoh Corporation, and having an internal diameter of 6.0 mm and a length of 15 cm are used as columns. Tetrahydrofuran (THF) is used as an eluting solvent. As for the experimental conditions, the sample density, the flow velocity, the sample injection amount and the measurement temperature are respectively 0.5% by mass, 0.6 ml/minute, 10 μl and 40° C. An IR detector is used in the measurement The analytical curve is drawn on the basis often samples of "polystylene standard sample TSK standard": "A-500", "F-1", "F-10", "F-80", "F-380", "A-2500", "F-4", "F-40", "F-128" and "F-700" manufactured by Tosoh Corporation.

Glass Transition Temperature of Resin Particles, and Melting Point of Releasing Agent The glass transition temperature (Tg) of the resin particles and the melting point of the releasing agent are measured with a differential scanning calorimeter DSC-50 (trade name) manufactured by Shimadzu Corporation at a programming rate of 3° C./minute. The glass transition temperature is defined at a temperature at which the extended lines of a baseline and a leading (rising) line in a heat absorbing part intersect with each other. The melting point is defined as a temperature at which a heat absorbing peak appears.

<Manufacture of Toner Mother Particles>

Preparation of Resin Particle Dispersion Liquid

| | |
|---|---|
| Styrene | 370 parts |
| n-Butyl acrylate | 30 parts |
| Acrylic acid | 8 parts |
| Dodecanethiol | 24 parts |
| Divinyl adipate | 5 parts |

The above components are mixed with each other to prepare a solution. Six parts of a nonionic surfactant NONIPOLE 400 (trade name) manufactured by Sanyo Chemical Industries, and 10 parts of an anionic surfactant NEOGEN SC (trade name) manufactured by Dai-Ichi Kogyo Seiyaku Co., Ltd. are dissolved in 550 parts of deionized water. The two solutions are mixed with each other in a flask, and emulsion polymerization is then conducted. A solution in which six parts of ammonium persulfate is dissolved in 50 parts of deionized water is added to the resultant reaction solution, which is being slowly stirred, over ten minutes.

After the internal air of the flask is replaced with nitrogen gas, the content in the flask, which is being stirred, is heated to 70° C. in an oil bath so as to continue the emulsion polymerization for five hours. As a result a resin particle dispersion liquid in which resin particles having a volume-average particle diameter of 150 nm, Tg of 58° C., and a weight-average molecular weight Mw of 35,500 are dispersed is obtained. The solid content concentration of the dispersion liquid is 40%.

Preparation of Coloring Agent Dispersion Liquid (1)

| | |
|---|---|
| Carbon black MOGUL L (trade name) manufactured by Cabot Corporation | 60 parts |
| Nonionic surfactant NONIPOLE 400 (trade name) manufactured by Sanyo Chemical Industries | 6 parts |
| Deionized water | 240 parts |

The above components are mixed with each other, and the resultant mixture is stirred for ten minutes with a homogenizer ULTRATALAX T50 (trade name) manufactured by IKA Company. The mixture is further stirred with an ultimizer to prepare a coloring agent dispersion liquid (1) in which coloring agent (carbon black) particles having a volume-average particle diameter of 250 nm are dispersed.

Preparation of Coloring Agent Dispersion Liquid (2)

| | |
|---|---|
| Cyan pigment (C.I. pigment blue 15:3) | 60 parts |
| Nonionic surfactant NONIPOLE 400 (trade name) manufactured by Sanyo Chemical Industries | 5 parts |
| Deionized water | 240 parts |

The above components are mixed with each other, and the resultant mixture is stirred for ten minutes with a homogenizer ULTRATALAX T50 (trade name) manufactured by IKA Company. The mixture is further stirred with an ultimizer to prepare a coloring agent dispersion liquid (2) in which coloring agent (cyan pigment) particles having a volume-average particle diameter of 250 nm are dispersed.

Preparation of Coloring Agent Dispersion Liquid (3)

| | |
|---|---|
| Magenta pigment (C.I. pigment red 122) | 60 parts |
| Nonionic surfactant NONIPOLE 400 (trade name) manufactured by Sanyo Chemical Industries) | 5 parts |
| Deionized water | 240 parts |

The above components are mixed with each other, and the resultant m is stirred for ten minutes with a homogenizer ULTRATALAX T50 (trade name) manufactured by IKA Company. The mixture is further stirred with an ultimizer to prepare a coloring agent dispersion liquid (3) in which coloring agent (magenta pigment) particles having a volume-average particle diameter of 250 nm are dispersed.

Preparation of Coloring Agent Dispersion Liquid (4)

| | |
|---|---|
| Yellow pigment (C.I. pigment yellow 180) | 90 parts |
| Nonionic surfactant NONIPOLE 400 (trade name) manufactured by Sanyo Chemical Industries | 5 parts |
| Deionized water | 240 parts |

The above components are mixed with each other, and the resultant mixture is stirred for ten minutes with a homogenizer ULTRATALAX T50 (trade name) manufactured by IKA Company. The mixture is further stirred with an ultimizer to prepare a coloring agent dispersion liquid (4) in which coloring agent (yellow pigment) particles having a volume-average particle diameter of 250 nm are dispersed.

Releasing Agent Dispersion Liquid

| | |
|---|---|
| Paraffine wax HNP0190 (trade name) manufactured by Nippon Seiro Co., Ltd., and having a melting point of 85° C. | 100 parts |
| Cationic surfactant SANISOL B50 (trade name) manufactured by Kao Corporationoration | 5 parts |
| Deionized water | 240 parts |

The above components are stirred in a round flask made of stainless steel for ten minutes with a homogenizer ULTRATALAX T50 (trade name) manufactured by IKA Company, and are further stirred with a pressure discharge type homogenizer to prepare a releasing agent dispersion liquid in which releasing agent particles having a volume-average particle diameter of 550 nm are dispersed.

Production of Toner Mother Particles K1

| | |
|---|---|
| Resin particle dispersion liquid | 234 parts |
| Coloring agent dispersion liquid (1) | 30 parts |
| Releasing agent dispersion liquid | 40 parts |
| Polyaluminium hydroxide PAHO 2S (trade name) manufactured by Asada Chemical Company | 0.5 parts |
| Deionized water | 600 parts |

The above components are mixed, and stirred in a round flask made of stainless steel with a homogenizer ULTRATALAX T50 (trade name) manufactured by IKA Company The content of the flask, which is being stirred, is heated to 40° C. in an oil bath, and kept at 40° C. for 30 minutes. The generation of agglomerates having a volume-average particle diameter of 4.5 μm is confirmed. The content of the flask is heated to 56° C. in the oil bath and kept at 56° C. for one hour. It is confirmed that the volume-average particle diameter of the agglomerates is 5.3 μm. After 26 parts of the resin particle dispersion liquid is added to the dispersion containing the agglomerates, the resultant mixture is heated to 50° C. in the oil bath and kept at 50° C. for 30 minutes. Then, 1N sodium hydroxide is added to the resultant reaction system to adjust the pH of the system to 7.0. The flask is then sealed, and the system, which is being stirred with a magnetic seal, is heated to 80° C. and kept at 80° C. for four hours (fusing step). After the system is cooled, the system is filtrated to collect a product The product is washed with deionized water four times, and freeze-dried to obtain toner mother particles K1. The volume-average particle diameter of the toner mother particles K1 is 5.9 μm, and the shape factor SF 1 thereof is 132.

Production of Toner Mother Particles K2

| | |
|---|---|
| Polyester resin (linear polyester made from terephthalic acid, bisphenol-A ethylene oxide adduct, and cyclohexanedimethanol, and having Tg of 62° C., Mn of 12,000, and Mw of 32,000) | 100 parts |
| Carbon black MOGUL L (trade name) manufactured by Cabot Corporation | 4 parts |
| Carnauba wax | 5 parts |

The above components are mixed, and the resultant mixture is kneaded with an extruder at 140° C. and ground with a jet mill. The resultant particles are classified with an air classifier, and toner mother particles K2 having a volume-average particle diameter of 5.9 μm and a shape factor SF1 of 145 are thus obtained.

Production of Toner Mother Particles C1

Toner mother particles C1 are produced in the same manner as the toner mother particles K1, except that the coloring agent dispersion liquid (2) is used instead of the coloring agent dispersion liquid (1). The volume-average particle diameter of the toner mother particles C1 is 5.8 μm, and the shape factor SF1 thereof is 131.

Production of Toner Mother Particles M1

Toner mother particles M1 are produced in the same manner as the toner mother particles K1, except that the coloring agent dispersion liquid (3) is used instead of the coloring agent dispersion liquid (1). The volume-average particle diameter of the toner mother particles M1 is 5.5 μm, and the shape factor SF1 thereof is 135.

Production of Toner Mother Particles Y1

Toner mother particles Y1 are produced in the same manner as the toner mother particles K1, except that the coloring agent dispersion liquid (4) is used instead of the coloring agent dispersion liquid (1). The volume-average particle diameter of the toner mother particles Y1 is 5.9 μm, and the shape factor SF1 thereof is 130.

<Manufacture of Carrier>

| | |
|---|---|
| Ferrite particles (volume-average particle diameter: 50 μm) | 100 parts |
| Toluene | 14 parts |
| Styrene/methacrylate copolymer (component ratio: 90/10) | 2 parts |
| Carbon black R330 (trade name) manufactured by Cabot Corporation | 0.2 part |

First, the above components except the ferrite particles are stirred with a stirrer for ten minutes, and a coating dispersion liquid is prepared. Next, after the coating dispersion liquid and the ferrite particles are put into a vacuum degassing kneeder, and are stirred at 60° C. for 30 minutes, the resultant dispersion liquid is heated at a reduced pressure to deaerate and dry the dispersion liquid. A carrier is thus obtained. The volume specific resistance of the carrier at the time that an electric field of 1000 V/cm is applied thereto is $10^{11}$ Ωcm.

<Manufacture of Manganese Compound Particles>

A solution in which manganese sulfate is dissolved in sulfuric acid is electrolyzed at 95° C. by using, as a positive electrode, a titanium electrode and, as a negative electrode, a graphite electrode, and applying voltage to these electrodes. Thereby, manganese dioxide is deposited on the positive electrode. Next, the manganese dioxide deposited is removed from the positive electrode, and the manganese dioxide is coarsely ground with a wet ball mill to obtain coarse particles having a diameter of about 30 μm. The system is filtered to collect the coarse particles of the manganese dioxide. The coarse particles are dried. The coarse particles are finely ground and the resultant particles are classified to obtain fine particles having a desired diameter. Next, the resultant fine particles are washed with hot water kept at 80° C., and a slurry is prepared from the fine particles. Sodium hydroxide is added to the slurry to adjust the pH of the slurry to 6.5, and the slurry is filtered. The resultant particles are dried and ground to obtain the following two kinds of manganese compound particles.

Manganese dioxide particles 1 having a volume-average particle diameter of 1.0 μm, and a crystal particle diameter of 40 nm Manganese dioxide particles 2 having a volume-average particle diameter of 2.2 μm, and a crystal particle diameter of 40 nm X-ray diffraction measurement of each of the manganese dioxide particles 1 and 2 shows that the manganese dioxide particles 1 and 2 have a γ-type crystalline structure.

Next, the manganese dioxide particles 2 are calcined at 800° C. for 25 minutes in an electric furnace. The resultant sintered blocks are ground, and the resulting particles are classified to obtain the following manganese compound particles.

Dimanganese trioxide particles 1 having a volume-average particle diameter of 2.0 sn, and a crystal particle diameter of 40 nm X-ray diffraction measurement of the dimanganese trioxide particles 1 shows that the dimanganese trioxide particles 1 have a γ-type crystal structure.

Meanwhile, the manganese dioxide particles 1 are calcined at 400° C. for 15 minutes in an electric furnace. The resultant sintered blocks are ground, and the resulting particles are classified to obtain the following manganese compound particles.

Manganese dioxide particles 3 having a volume-average particle diameter of 0.2 μm, and a crystal particle diameter of 40 nm X-ray diffraction measurement of the manganese dioxide particles 3 shows that the dimanganese dioxide particles 3 have a γ-β-type crystalline structure.

<Manufacture of Photoreceptor X1>

| | |
|---|---|
| X-type metal-free phthalocyanine | 1 part |
| Vinyl chloride/vinyl acetate copolymer VMCH (trade name) manufactured by Union Carbide Corporation | 1 part |
| n-Butyl acetate (manufactured by Wako Pure Chemcal Industries, Ltd.) | 40 parts |

The above components are stirred with a sand mill containing glass beads whose diameter is 1 mm for two hours. An aluminum pipe having a diameter of 30 mm and a length of 340 mm is immersed in the resultant dispersion liquid to form a coating on the surface of the aluminum pipe. The coating is dried at 100° C. for ten minutes to obtain a charge-generating layer having a thickness of 0.5 μm.

Next, the aluminum pipe on which the charge-generating layer has been formed is immersed in a solution in which one part of benzoquinone and one part of a poly(4,4-cyclohexlidendiphenylene carbonate) resin are dissolved in six parts of monochlorobenzene to form another coating on the charge-generating layer. The coating is then dried at 135° C. for one hour to obtain a charge transport layer having a thickness of 20 μm. A photoreceptor X1 is thus produced.

Example 1

| | |
|---|---|
| Toner mother particles K1 | 100 parts |
| Manganese dioxide particles 1 | 1 part |
| Rutile-type titanium oxide having a volume-average particle diameter of 20 nm, and treated with n-decyltrimethoxysilane | 1 part |
| Silica having a volume-average particle diameter of 40 nm, produced by a vapor-phase oxidization method, and treated with silicone oil | 2 parts |

The above components are mixed, and the components mixed are blended with a Henschel mixer having a volume of five liters at a peripheral velocity of 30 m/s at an atmospheric temperature of 28° C. for ten minutes. The resultant blend is sifted with a sheave having a pore size of 45 μm to remove coarse particles therefrom. Toner 1 is thus obtained.

Hundred parts of the carrier and five parts of toner 1 are stirred with a V-blender at 40 rpm for 20 minutes, and the resultant is sifted with a sheave having a pore size of 212 μm to obtain developer 1.

Example 2

| | |
|---|---|
| Toner mother particles K1 | 100 parts |
| Dimanganese trioxide particles 1 | 1 part |
| Rutile-type titanium oxide having a volume-average particle diameter of 20 nm, and treated with n-decyltrimethoxysilane | 1 part |
| Silica having a volume-average particle diameter of 40 nm, produced by a vapor-phase oxidization method, and treated with silicone oil | 2 parts |

The above components are mixed, and the components mixed are blended with a Henschel mixer having a volume of five liters at a peripheral velocity of 30 m/s at an atmospheric temperature of 28° C. for ten minutes. The resultant blend is sifted with a sheave having a pore size of 45 μm to remove coarse particles therefrom. Toner 2 is thus obtained.

Hundred parts of the carrier and five parts of toner 2 are stirred with a V-blender at 40 rpm for 20 minutes, and the resultant is sifted with a sheave having a pore size of 212 μm to obtain developer 2.

Example 3

| | |
|---|---|
| Toner mother particles K1 | 100 parts |
| Manganese dioxide particles 3 | 1 part |
| Rutile-type titanium oxide having a volume-average particle diameter of 20 nm, and treated with n-decyltrimethoxysilane | 1 part |
| Silica having a volume-average particle diameter of 40 nm, produced by a vapor-phase oxidization method, and treated with silicone oil | 2 parts |

The above components are mixed, and the components mixed are blended with a Henschel mixer having a volume of five liters at a peripheral velocity of 30 m/s at an atmospheric temperature of 28° C. for ten minutes. The resultant blend is sifted with a sheave having a pore size of 45 μm to remove coarse particles therefrom. Toner 3 is thus obtained.

Hundred parts of the carrier and five parts of toner 3 are stirred with a V-blender at 40 rpm for 20 minutes, and the resultant is sifted with a sheave having a pore size of 212 μm to obtain developer 3.

Example 4

Toner 4 and developer 4 are produced in the same manner as in Example 1, except that the toner mother particles K2 are used instead of the toner mother particles K1, and except that the resultant toner 4 is used instead of toner 1.

Example 5

| | |
|---|---|
| Toner mother particles C1 | 100 parts |
| Manganese dioxide particles 1 | 1 part |
| Cerium oxide (volume-average particle diameter: 0.7 μm) | 1 part |
| Rutile-type titanium oxide having a volume-average particle diameter of 20 nm, and treated with n-decyltrimethoxysilane | 1 part |
| Silica produced by a vapor-phase oxidization method, having a volume-average particle diameter of 40 nm, and treated with silicone oil | 2 parts |

The above components are mixed, and the components mixed are blended with a Henschel mixer having a volume of five liters at a peripheral velocity of 30 m/s for 15 minutes. The resultant blend is sifted with a sheave having a pore size of 45 μm to remove coarse particles therefrom. Toner 5 (cyan toner) is thus obtained.

Toner 6 (magenta toner) and toner 7 (yellow toner) are produced in the same manner as the cyan toner, except that the toner mother particles M1 and Y1 are respectively used instead of the toner mother particles C1.

Hundred parts of the carrier and five parts of each of toners 5 to 7 are stirred with a V-blender at 40 rpm for 20 minutes, and the resultant is sifted with a sheave having a pore size of 212 μm to obtain developers 5 to 7. A combination of developers 1, and 5 to 7 is used as one set of color developers.

Comparative Example 1

| | |
|---|---|
| Toner mother particles K1 | 100 parts |
| Aluminum oxide particles 1 (volume-average particle diameter: 1.0 μm) | 1 part |
| Rutile-type titanium oxide having a volume-average particle diameter of 20 nm, and treated with n-decyltrimethoxysilane | 1 part |
| Silica produced by a vapor-phase oxidization method, having a volume-average particle diameter of 40 nm, and treated with silicone oil | 2 parts |

The above components are mixed, and the components mixed are blended with a Henschel mixer having a volume of five liters at a peripheral velocity of 30 m/s at an atmospheric temperature of 28° C. for ten minutes. The resultant blend is sifted with a sheave having a pore size of 45 μm to remove coarse particles therefrom. Toner 8 is thus obtained. Hundred parts of the carrier and five parts of toner 8 are stirred with a V-blender at 40 rpm for 20 minutes, and the resultant is sifted with a sheave having a pore size of 212 μm to obtain developer 8.

Comparative Example 2

| | |
|---|---|
| Toner mother particles K1 | 100 parts |
| Aluminum oxide particles 2 (volume-average particle diameter: 2.0 μm) | 1 part |

-continued

| | |
|---|---|
| Rutile-type titanium oxide having a volume-average particle diameter of 20 nm, and treated with n-decyltrimelhoxysilane | 1 part |
| Silica produced by a vapor-phase oxidization method, having a volume-average particle diameter of 40 nm, and treated with silicone oil | 2 parts |

The above components are mixed, and the components mixed are blended with a Henschel mixer having a volume of five liters at a peripheral velocity of 30 m/s at an atmospheric temperature of 28° C. for ten minutes. The resultant blend is sifted with a sheave having a pore size of 45 μm to remove coarse particles therefrom. Toner 9 is thus obtained. Hundred parts of the carrier and five parts of toner 9 are stirred with a V-blender at 40 rpm for 20 minutes, and the resultant is sifted with a sheave having a pore size of 212 μm to obtain developer 9.

Comparative Example 3

| | |
|---|---|
| Toner mother particles K1 | 100 parts |
| Silicon carbide particles (volume-average particle diameter: 1.0 μm) | 0.5 part |
| Rutile-type titanium oxide having a volume-average particle diameter of 20 nm, and treated with n-decyltrimethoxysilane | 1 part |
| Silica produced by a vapor-phase oxidization method, having a volume-average particle diameter of 40 nm, and treated with silicone oil | 2 parts |

The above components are mixed, and the components mixed are blended with a Henschel mixer having a volume of five liters at a peripheral velocity of 30 m/s at an atmospheric temperature of 28° C. for ten minutes. The resultant blend is sifted with a sheave having a pore size of 45 μm to remove coarse particles therefrom. Toner 10 is thus obtained. Hundred parts of the carrier and five parts of toner 10 are stirred with a V-blender at 40 rpm for 20 minutes, and the resultant is sifted with a sheave having a pore size of 212 μm to obtain developer 10.

Comparative Example 4

| | |
|---|---|
| Toner mother particles K1 | 100 parts |
| Silicon carbide particles (volume-average particle diameter: 1.0 μm) | 1 part |
| Rutile-type titanium oxide having a volume-average particle diameter of 20 nm, and treated with n-decyltrimethoxysilane | 1 part |
| Silica produced by a vapor-phase oxidization method, having a volume-average particle diameter of 40 nm, and treated with silicone oil | 2 parts |

The above components are mixed, and the components mixed are blended with a Henschel mixer having a volume of five liters at a peripheral velocity of 30 m/s at an atmospheric temperature of 28° C. for ten minutes. The resultant blend is sifted with a sheave having a pore size of 45 μm to remove coarse particles therefrom. Toner 11 is thus obtained. Hundred parts of the carrier and five parts of toner 11 are stirred with a V-blender at 40 rpm for 20 minutes, and the resultant is sifted with a sheave having a pore size of 212 μm to obtain developer 11.

Comparative Example 5

Toner 12 and developer 12 are produced in the same manner as in Example 1, except that α-type manganese dioxide particles having a volume-average particle diameter of 1.0 μm and a crystal particle diameter of 40 nm are used instead of the manganese dioxide particles 1, and except that the resultant toner 12 is used instead of toner 1.

<Evaluation Test>

A device obtained by remodeling an image-forming device, DOCUCENTRE 505 (trade name) manufactured by Fuji Xerox Co., Ltd. so that each of developers 1 to 4 and 8 to 12 of the Examples and Comparative Examples can be used together with the photoreceptor X1 is used to evaluate properties of the black toners and developers. Another device by remodeling an image-forming device, DOCU PRINT C2221 (trade name) manufactured by Fuji Xerox Co., Ltd. so that the set of color developers can be used together with the photoreceptor X1 is used to evaluate properties of the color toners and developers. After an image, whose color is process black obtained by superimposing 1.3 g/cm$^2$ of each of toners 5 to 7, is formed with the latter device on 10,000 sheets of paper in each of three environments of ordinary temperature and ordinary humidity (temperature of 25° C., and humidity of 50% RH), high temperature and high humidity (temperature of 28° C., and humidity of 85% RH), and low temperature and low humidity (temperature of 10° C., and humidity 30% RH), the following evaluation of the resultant images is performed.

The density of each image (when the Docu print C2221 is used to form an image, the density of the resultant process black image) is measured with an image densitometer X-RITE 404A (trade name) manufactured by X-Rite Incorporated. The image is compared with each of samples of G1 (good) to G5 (poor) with naked eyes to determine whether the photoreceptor is scarred and to determine whether the image has a fogging portion. In the column of each of these items for each image, one of marks "G1 to G5" is shown so that the mark shown is the same as the mark (one of G1 to G5) of the sample whose quality is equal to that of the image. The mark G1 or G2 means a good image, and the mark G3, G4 or G5 means poor image. The image is also checked with naked eyes to determine whether the image has an image void and/or an image defect, and to determine whether the image has a black band, which shows cleaning failure.

The evaluation results under the ordinary temperature and ordinary humidity environment, those under the high temperature and high humidity environment, and those under the low temperature and low humidity environment are respectively shown in Tables 1 to 3.

TABLE 1

| | Evaluation Environment (25° C., 50% RH) | | | | | | |
|---|---|---|---|---|---|---|---|
| | Image Density | Fogging | Image void | Image defect | Cleaning failure (Black band) | Photoreceptor scarring | Comprehensive Judgment |
| Example 1 | 1.45 | G1 | Non-occurrence | Non-occurrence | Non-occurrence | G1 | Good |
| Example 2 | 1.45 | G1 | Non-occurrence | Non-occurrence | Non-occurrence | G1 | Good |
| Example 3 | 1.44 | G1 | Non-occurrence | Non-occurrence | Non-occurrence | G1 | Good |
| Example 4 | 1.40 | G1 | Non-occurrence | Non-occurrence | Non-occurrence | G1 | Good |
| Example 5 | 1.42 | G1 | Non-occurrence | Non-occurrence | Non-occurrence | G1 | Good |
| Comparative Example 1 | 1.43 | G1 | Non-occurrence | Non-occurrence | Non-occurrence | G1 | Good |
| Comparative Example 2 | 1.43 | G1 | Occurrence | Non-occurrence | Non-occurrence | G4 | Poor |
| Comparative Example 3 | 1.45 | G1 | Non-occurrence | Non-occurrence | Non-occurrence | G1 | Good |
| Comparative Example 4 | 1.43 | G1 | Non-occurrence | Non-occurrence | Non-occurrence | G4 | Poor |
| Comparative Example 5 | 1.43 | G1 | Non-occurrence | Non-occurrence | Non-occurrence | G1 | Good |

TABLE 2

| | Evaluation Environment (28° C., 85% RH) | | | | | | |
|---|---|---|---|---|---|---|---|
| | Image Density | Fogging | Image void | Image defect | Cleaning failure (Black band) | Photoreceptor scarring | Comprehensive Judgment |
| Example 1 | 1.41 | G1 | Non-occurrence | Non-occurrence | Non-occurrence | G1 | Good |
| Example 2 | 1.42 | G1 | Non-occurrence | Non-occurrence | Non-occurrence | G1 | Good |
| Example 3 | 1.42 | G1 | Non-occurrence | Non-occurrence | Non-occurrence | G1 | Good |
| Example 4 | 1.41 | G1 | Non-occurrence | Slight occurrence | Non-occurrence | G1 | Good |
| Example 5 | 1.41 | G1 | Non-occurrence | Non-occurrence | Non-occurrence | G1 | Good |
| Comparative Example 1 | 1.41 | G1 | Non-occurrence | Occurrence | Occurrence | G1 | Poor |
| Comparative Example 2 | 1.37 | G3 | Non-occurrence | Slight occurrence | Non-occurrence | G3 | Poor |

TABLE 2-continued

| | Evaluation Environment (28° C., 85% RH) | | | | | | |
|---|---|---|---|---|---|---|---|
| | Image Density | Fogging | Image void | Image defect | Cleaning failure (Black band) | Photoreceptor scarring | Comprehensive Judgment |
| Comparative Example 3 | 1.41 | G1 | Non-occurrence | Occurrence | Occurrence | G1 | Poor |
| Comparative Example 4 | 1.41 | G1 | Non-occurrence | Non-occurrence | Non-occurrence | G3 | Poor |
| Comparative Example 5 | 1.41 | G1 | Non-occurrence | Occurrence | Non-occurrence | G1 | Poor |

TABLE 3

| | Evaluation Environment (10° C., 30% RH) | | | | | | |
|---|---|---|---|---|---|---|---|
| | Image Density | Fogging | Image void | Image defect | Cleaning failure (Black band) | Photoreceptor scarring | Comprehensive Judgment |
| Example 1 | 1.46 | G1 | Non-occurrence | Non-occurrence | Non-occurrence | G1 | Good |
| Example 2 | 1.47 | G1 | Non-occurrence | Non-occurrence | Non-occurrence | G2 | Good |
| Example 3 | 1.45 | G1 | Non-occurrence | Non-occurrence | Non-occurrence | G1 | Good |
| Example 4 | 1.43 | G1 | Non-occurrence | Non-occurrence | Non-occurrence | G1 | Good |
| Example 5 | 1.44 | G1 | Non-occurrence | Non-occurrence | Non-occurrence | G1 | Good |
| Comparative Example 1 | 1.44 | G1 | Non-occurrence | Non-occurrence | Non-occurrence | G1 | Good |
| Comparative Example 2 | 1.45 | G1 | Occurrence | Non-occurrence | Non-occurrence | G5 | Poor |
| Comparative Example 3 | 1.46 | G1 | Non-occurrence | Non-occurrence | Non-occurrence | G2 | Good |
| Comparative Example 4 | 1.46 | G1 | Non-occurrence | Non-occurrence | Non-occurrence | G4 | Poor |
| Comparative Example 5 | 1.44 | G1 | Non-occurrence | Non-occurrence | Non-occurrence | G1 | Good |

The developers of Examples 1 to 3, and 5 show an excellent cleaning property under each of the three environments, and do not cause problems of fogging, image void, image defect and scarring of the photoreceptor. Although image defects occur under the low temperature and low humidity environment in Example 4, the degree thereof is extremely low.

On the other hand, the developer of Comparative Example 1 containing the aluminum oxide particles 1 as the abrasive particles has small polishing action, and black bands and image defects due to cleaning failure occur under the high temperature and high humidity environment.

In the developer of Comparative Example 2 including the aluminum oxide particles 2 whose diameter is larger than that of the aluminum oxide particles1 and whose amount is larger than that of the aluminum oxide particles 1 contained in Comparative Example 1, a black band due to cleaning failure does not occur, and the degree of image defects is very low under the high temperature and high humidity environment. However, image voids and scarring of the photoreceptor whose degree is higher than the tolerance limit, which are caused by firm adherence of the aluminum oxide particles to the photoreceptor, occur under the three environments. In addition, reduced image density and fogging are found under the high temperature and high humidity environment.

The developer of Comparative Example 3 including the silicon carbide as the abrasive particles has small polishing action, and black bands and image defects due to cleaning failure occur under the high temperature and high humidity environment. Scarring of the photoreceptor, whose degree is below the tolerance limit, occurs under the low temperature and low humidity environment.

Although the developer of Comparative Example 4 in which the amount of silicon carbide is larger than in Comparative Example 3 has an excellent cleaning property, scarring of the photoreceptor whose degree exceeds the tolerance limit occurs under the three environments.

In Comparative Example 5 including the manganese compound particles with an α-type crystalline structure as the abrasive particles, the polishing effect is small, and image defects due to cleaning failure occurs under the high temperature and high humidity environment.

What is claimed is:

1. A toner for developing an electrostatic latent image comprising:

toner mother particles containing a binder resin and a colorant; and manganese compound particles having a γ-type crystalline structure.

2. The toner for developing an electrostatic latent image of claim 1, wherein the manganese compound particles are obtained by an electrolysis method.

3. The toner for developing an electrostatic latent image of claim 1, comprising a manganese compound which includes the manganese compound particles, wherein the content of the manganese compound particles in the manganese compound ranges from 20 to 100% by mass.

4. The toner for developing an electrostatic latent image of claim 1, wherein the manganese compound particles have a volume-average particle diameter of 0.2 μm to 2.0 μm.

5. The toner for developing an electrostatic latent image of claim 1, wherein (B/A) is within the range of 0.02 to 0.2 when the volume-average particle diameter of the toner is defined as (A) and the volume-average particle diameter of the manganese compound particles is defined as (B).

6. The toner for developing an electrostatic latent image of claim 1, wherein the content of the manganese compound particles is within the range of 0.1 to 10% by mass with respect to the toner mother particles.

7. The toner for developing an electrostatic latent image of claim 1, further comprising abrasive particles other than the manganese compound particles.

8. The toner for developing an electrostatic latent image of claim 7, wherein (C/D) is within the range of 0 to 1.5 when the amount of the abrasive particles is defined as (C) and the amount of the manganese compound particles is defined as (D).

9. The toner for developing an electrostatic latent image of claim 1, wherein the volume-average particle diameter of the toner is within the range of 2 to 12 μm.

10. The toner for developing an electrostatic latent image of claim 1, wherein the volume average particle size distribution index GSDv of the toner is within the range of 1.00 to 1.30.

11. The toner for developing an electrostatic latent image of claim 1, wherein the shape factor SF1 of the toner is within the range of 110 to 140.

12. A developer for developing an electrostatic latent image, comprising a toner for developing an electrostatic latent image including toner mother particles containing a binder resin and a colorant, and manganese compound particles having a γ-type crystalline structure.

13. The developer for developing an electrostatic latent image of claim 12, further comprising carrier particles having an average particle diameter of 30 to 200 μm.

14. The developer for developing an electrostatic latent image of claim 13, wherein the carrier particles comprise core particles coated with a resin, and the amount of the resin is 0.1 to 10 parts by mass based on 100 parts by mass of the core particles.

15. A method for manufacturing a toner for developing an electrostatic latent image, comprising:

mixing a resin particle dispersion liquid in which resin particles having a volume-average particle diameter of 1 μm or less are dispersed, and a coloring agent dispersion liquid in which coloring agent particles are dispersed, and aggregating the resin particles and the coloring agent particles to produce agglomerates;

heating and fusing the agglomerates to a temperature higher than the glass transition temperature of the resin particles to produce toner mother particles; and mixing the toner mother particles with manganese compound particles having a γ-type crystalline structure.

* * * * *